United States Patent [19]

Boehm

[11] 4,064,429

[45] Dec. 20, 1977

[54] ILLUMINATED FLASHER CANE OF ROUND HOLLOW PLASTIC TUBING OR THE LIKE

[76] Inventor: Lawrence O. Boehm, 2002 Lowery, Poplar Bluff, Mo. 63901

[21] Appl. No.: 563,108

[22] Filed: May 22, 1975

[51] Int. Cl.[2] ..... F31V 33/00

[52] U.S. Cl. ..... 362/102

[58] Field of Search ..... 240/6.42

[56] References Cited

U.S. PATENT DOCUMENTS

| | | | |
|---|---|---|---|
| 1,659,346 | 2/1928 | Beatty | 240/6.42 |
| 2,173,624 | 9/1939 | Dyer | 240/6.42 |
| 2,271,190 | 1/1942 | Giaimo | 240/6.42 |
| 2,435,650 | 2/1948 | Greene | 240/6.42 |
| 2,642,519 | 6/1953 | Caustin et al. | 240/6.42 |
| 3,336,469 | 8/1967 | Barnes, Sr. et al. | 240/6.42 |

FOREIGN PATENT DOCUMENTS

| | | | |
|---|---|---|---|
| 225,374 | 1/1963 | Austria | 240/6.42 |
| 629,740 | 7/1963 | Belgium | 240/6.42 |
| 452,749 | 11/1948 | Canada | 240/6.42 |
| 1,027,932 | 2/1953 | France | 240/6.42 |
| 536,610 | 5/1941 | United Kingdom | 240/6.42 |
| 535,829 | 4/1941 | United Kingdom | 240/6.42 |
| 536,423 | 5/1941 | United Kingdom | 240/6.42 |

*Primary Examiner*—Russell E. Adams

[57] ABSTRACT

The invention relates to an illuminated walking cane in which the illumination means is adapted to be flashed on and off by the user.

3 Claims, 8 Drawing Figures

ILLUMINATED FLASHER CANE OF ROUND HOLLOW PLASTIC TUBING OR THE LIKE

The present invention relates to an illuminated walking cane in which the illumination means is adapted to be flashed on and off by the user.

An object of the present invention is to provide an illuminated walking cane for aged, blind or otherwise handicapped individuals in which the illumination means is adapted to be flash by the user to signal for assistance.

Another object of the present invention is to provide an illuminated walking cane sufficiently simple in construction to facilitate assembly by the handicapped.

Still another object of the present invention is to provide an illuminated walking cane having a detachably mounted pistol grip like handle.

Still another object of the present invention is to provide an illuminated walking cane manufactured from translucent, hollow plastic tubing of any desired color, and having two opposed reflectors within the shank of the cane to more evenly distribute the light from the illumination means over the length of the shank.

These and other objects of the invention will become clear by reference to the attached drawings and to the following detailed description and appended claims.

Figures 1, 2, 3, 4, 5, 6, 7, 8:
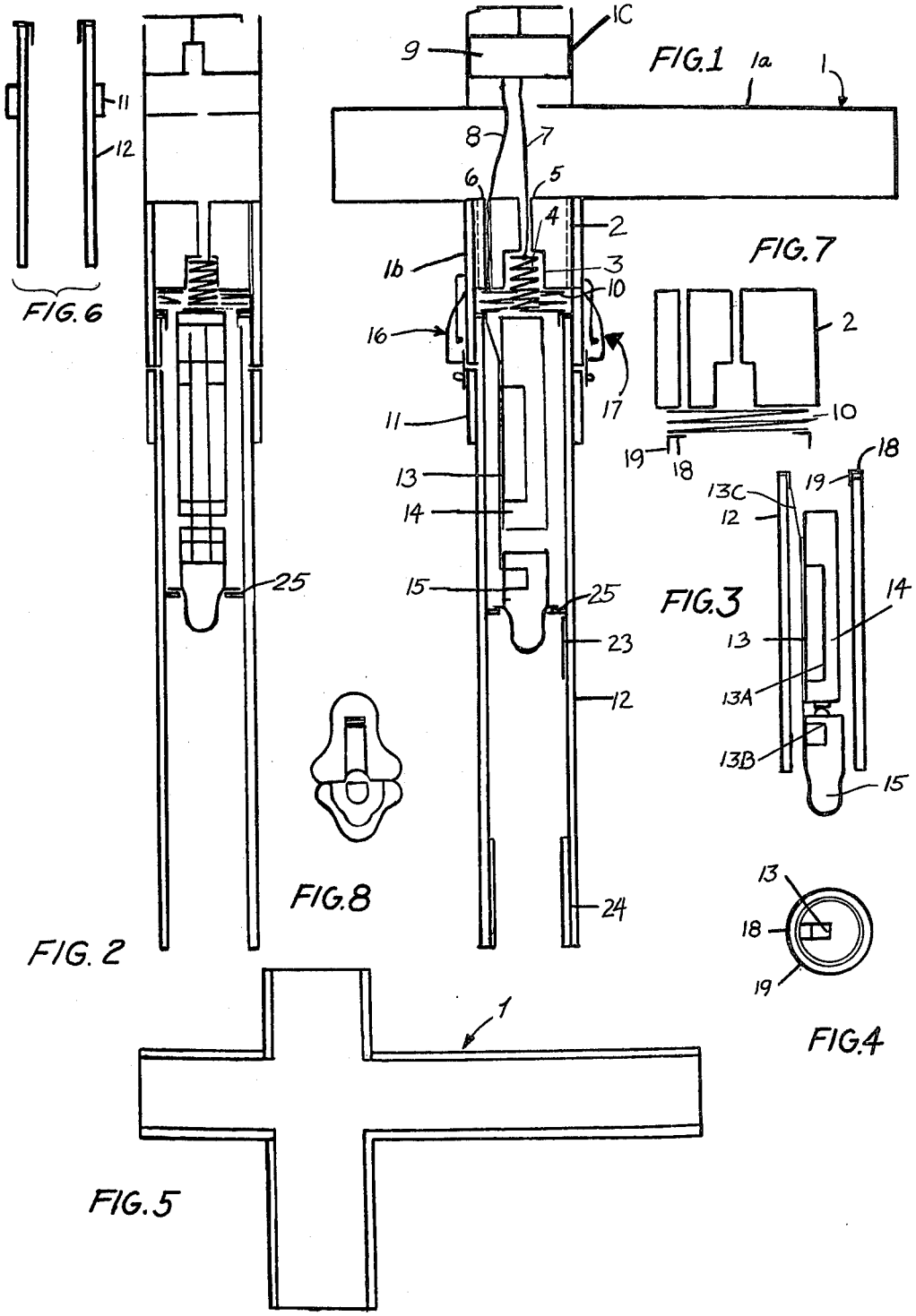
FIG. 1 is a side vertical sectional view of the cane.
FIG. 2 is a front vertical sectional view of the cane.
FIG. 3 is a partial vertical sectional view of the cane showing the illumination module in more detail.
FIG. 4 is a cross-sectional view of FIG. 3.
FIG. 5 is a side vertical sectional view of the handle of the cane.
FIG. 6 is a vertical sectional view of the shank of the cane.

FIG. 7 is a partial vertical sectional view of the cane showing the plastic plug 2, spring 10 and the ring 18, 19;

FIG. 8 shows one of the two tension draw bolt metal locks used to attach the handle 1 to the shank 12.

Referring to FIG. 1 the cane is shown having a tubular shank 12 made from translucent, colored plastic tubing detachably connected to the handle 1 via two tension draw bolt metal locks 16 and 17.

The illumination module shown in FIG. 3 is comprised of a metalic bracket 13 having a first clip 13*a* of semicircular cross section adapted to hold a battery 14. The bracket 13 further comprises a second clip 13*b* adapted to hold a lamp 15 in electrical contact with the battery 14. A connecting element 13*c* links the bracket 13 with the ring 19. The ring 19 has an outward extending annular flange 18. When the illumination modular is inserted into the shank 12, the flange seats on the end of the shank, thus preventing the module from being inserted any further. A disc shaped stop 25 having a central opening is provided within the shank 12 so that when the module is inserted fully within the shank, the lamp 15 will protrude through the central opening. This keeps the illumination module alined with the axis of the shank regardless of the position of the cane.

Handle 1 is comprised of a tubular grip 1*a* and two tubular arms 1*b* and 1*c* extending out from the grip 1*a* at right angles. The arm 1*b* has an inside diameter substantially the same as the outside diameter of the tubular shank 12 so that the end of the shank 12 can be inserted into the arm 1*b*. A cylindrical plastic plug 2 having a centrally located cylindrical hole 3 and two wire conduits 5 and 6 is inserted into arm 1*b* as shown in FIG. 1. A push button switch 9 is mounted within the arm 1*c*. Electrical conductors 7 and 8 are connected to the push button 9 and are run through conduits 5 and 6 and are electrically connected to, respectively, a first compression spring 4 and a second compression spring 10 having a diameter substantially the same as the diameter of the annular flange 18. To assemble the cane, the end of the shank 12 is inserted into the arm 1*b* of the handle 1. As the shank is inserted, the end of spring 10 contacts the flange 18 and the spring 3 contacts the base posted of the battery 14, thus making electrical contact with the illumination module. The handle 1 is locked into position by closing the two tension draw bolt metal locks 16 and 17. An annular ring 11 having a diameter substantially the same as arm 1*b* is provided around shank 12 to stop the shank from being inserted too far into arm 1*b*.

The locks 16 and 17 shown in the drawings are of course, similar to the keyless locks often found on low priced luggage. However, other fastening devices of the same nature and purpose may be substituted.

The invention is susceptible of various changes in its form, proportions and construction. Therefore, the invention should not be limited by the specific embodiment recited above but should be construed as broad as properly falls within the scope of the appended claims.

I hereby claim:

1. An illuminated walking cane comprising a handle having a grip means and first and second hollow arm means extending from said grip means at right angles thereto, a hollow shank, locking means adapted to detachably lock said handle to said shank, said handle further comprised of a cylindrical plug inserted within said first arm means, switch means mounted within said second arm means, said plug having a cylindrical recess aligned with the axis of said plug and adapted to receive first spring means; second spring means positioned within said first arm means on the same side of said plug as said first spring means, said shank having first and second ends and further comprised of an illumination module inserted into said first end, said illumination module having bracket means, a battery having first and second contacts supported by said bracket means, a lamp means supported by said bracket means and held in electrical contact with said first battery contact, annular flange means contacting said first end when said module is fully inserted into said shank, said first spring means engaging said second battery contact and said second spring means engaging said annular flange when said handle and shank are locked together by said locking means, electrical conductor means connecting said switch means to said first and second spring means, said flange and bracket means additionally forming part of the electrical circuit between said switch and lamp means.

2. The illuminated walking cane set forth in claim 1 wherein said shank is comprised of translucent plastic tubing of circular cross section.

3. The illuminated walking cane set forth in claim 1 wherein said shank further includes first and second reflector means within said shank, said first reflector means being positioned behind said lamp means and said second reflector means positioned in front of said lamp means a distance down said shank, said reflector means providing a more even distribution of the light from said lamp means along said shank.

* * * * *